United States Patent [19]

Gaudino

[11] Patent Number: 4,753,782

[45] Date of Patent: Jun. 28, 1988

[54] CEMENTED SILVER POWDER

[75] Inventor: Larry J. Gaudino, Westmoreland, Pa.

[73] Assignee: GTE Products Corporation, Stamford, Conn.

[21] Appl. No.: 45,808

[22] Filed: Apr. 27, 1987

Related U.S. Application Data

[63] Continuation of Ser. No. 536,039, Sep. 26, 1983, abandoned.

[51] Int. Cl.[4] ..... B22F 1/00; C01G 5/00

[52] U.S. Cl. ..... 423/42; 75/0.5 A; 75/0.5 B; 75/65 R; 75/109; 419/2; 419/28; 419/38

[58] Field of Search ..... 423/23, 27, 42; 75/108, 75/109, 118 R, 65 R, 0.5 A, 0.5 B; 419/2, 28, 38

[56] References Cited

U.S. PATENT DOCUMENTS 3,660,079 5/1972 Govani ..... 75/109
4,039,317 8/1977 Montani et al. ..... 75/0.5 A

FOREIGN PATENT DOCUMENTS 829704 5/1981 U.S.S.R. ..... 75/109

*Primary Examiner*—John Doll
*Assistant Examiner*—Jeffrey Edwin Russel
*Attorney, Agent, or Firm*—James Theodosopoulos

[57] ABSTRACT

Cemented silver powder is thermal conditioned in order to preserve the cemented silver powder morphology through subsequent processing operations.

3 Claims, 3 Drawing Sheets

CEMENTED SILVER POWDER

This application is a continuation of application Ser. No. 536,039, filed Sept. 26, 1983, now abandoned.

This invention concerns cemented silver powder. Such powder is produced by a galvanic or ion substitution process, such as is disclosed in U.S. Pat. No. 3,874,940, and comprises aggregates or agglomerates of individual particles. Silver powder produced by other methods, such as the precipitation processes disclosed in U.S. Pat. Nos. 2,752,237 and 4,039,317, does not generally comprise aggregates; the powder comprises essentially the individual particles.

In the galvanic process, a precipitate of a silver compound, for example, silver chloride precipitated from a silver nitrate solution by the addition of chloride ions, is reduced to a pure metal by a less electronegative metal such as copper, iron or zinc. During the galvanic reaction, collision and cohesion of extremely fine individual particles results in the particles partially fusing together to form porous, somewhat irregularly rounded aggregates ranging in size from about 60 to 150 microns in diameter. Bond strengths between the individual interior fine particles are quite weak, making the formed aggregates quite fragile. Thus, subsequent processing operations, such as blending, milling and/or classifying in order to obtain desired powder characteristics, tend to disperse the formed aggregates.

This invention is concerned with preserving the cemented or sponge type morphology of the as-produced silver powder while still being able to control behavioral characteristics of the powder, such as apparent density and flowability. The cemented type morphology can be useful in applications where porous silver is desired such as electrical contacts, porous silver electrodes, catalysts and thermal dispersants in high-speed diamond grinding wheels, such as are disclosed in U.S. Pat. Nos. 2,672,415, 2,776,331, 2,862,985, 2,881,238 and 3,501,350. I have found that by thermally conditioning the cemented silver powder, by heating the powder at predetermined times and temperatures, the sponge type morphology can be preserved while still permitting the powder to undergo subsequent processing, if necessary, such as milling, blending and/or classifying, to obtain desired powder characteristics.

Figure 1:
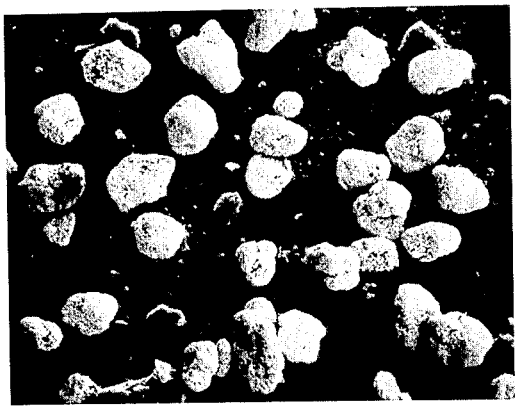
FIG. 1 shows agglomerated particles of as-produced cemented silver powder at 80 magnification.

In one example, cemented silver powder was produced as follows. 1,575 grams of sodium chloride were added to 45 liters of a 3% silver nitrate solution, thereby forming silver chloride precipitate. The silver chloride was washed free of any residual chlorides with deionized water, and was then resuspended in 21 liters of 4% sulfuric acid, the temperature thereof being stabilized for 30 minutes at 70° C. Slowly, 1,050 grams of fine zinc dust (about one micron in diameter) was added to the silver chloride suspension. A reaction caused the zinc and chloride to combine to form a water soluble compound, leaving behind the pure cemented silver powder. The powder was dried at 90° C. until a moisture content of less than 0.05% was obtained. The powder was then subjected to a 100 mesh classifying process to separate agglomerates, and to remove agglomerates larger than 160 microns. A vibratory classifier with an inserted 100 mesh screen was used. The powder had an apparent density (ASTM method, B329-76) of 15.24 grams per cubic inch and a flow rate (ASTM method, B213-77) of 70 seconds. The mean particle diameter was less than one micron and the mean aggregate diameter was 108 microns.

Thermal conditioning of the powder at 450° C for 30 minutes increased the apparent density to 24.94 grams per cubic inch and reduced the flow rate to 48.6 seconds. The thermal conditioning was carried out as follows. The powder was flowed into a stainless steel tray having a maximum depth of three inches; deeper trays produce thicker harder powder cakes after thermal conditioning, which can result in the need for excessive blending. An electric furnace was used for the thermal conditioning. The powder cake could be easily broken up by hand, and was hand screened through 100 mesh, after which the apparent density and flow rate were measured. This thermal conditioning step increased the mean particle diameter to 4.6 microns and reduced the mean aggregate diameter to 92.6 microns.

Blending the thermally conditioned powder increased the apparent density to 27.3 grams per cubic inch and reduced the flow rate to 41.9 seconds. The blending was performed in a ½ cubic foot twin cone V-blender for 30 minutes using 50 troy ounces of powder, after which the powder was classified through 100 mesh. Blending did not substantially change mean particle diameter or mean aggregate diameter.

Thermal conditioning as-produced powder at 500° C. for 30 minutes resulted in an apparent density of 28.26 and a flow rate of 42.5. Blending for 30 minutes increased the apparent density to 31.0 and reduced the flow rate to 37.1. The mean particle diameter was 6.0 microns and the mean aggregate diameter was 85.8 microns.

Thermal conditioning as-produced powder at 540° C. for 30 minutes resulted in an apparent density of 33.24 and a flow rate of 38.8. Blending for 30 minutes increased the apparent density to 36.0 and reduced the flow rate to 34.3. The mean particle diameter was 8.5 microns and the mean aggregate diameter was 81.2 microns.

Figure 2:
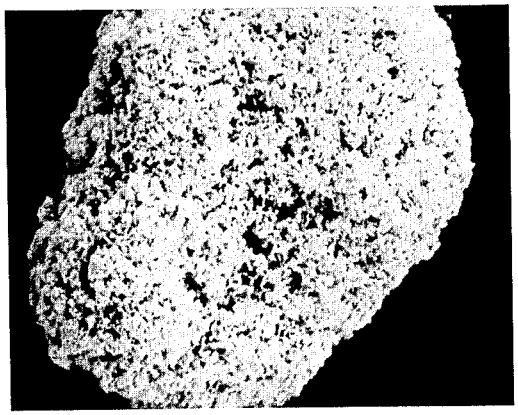
FIG. 2 shows one such agglomerate at 800 magnification.
Figure 3:
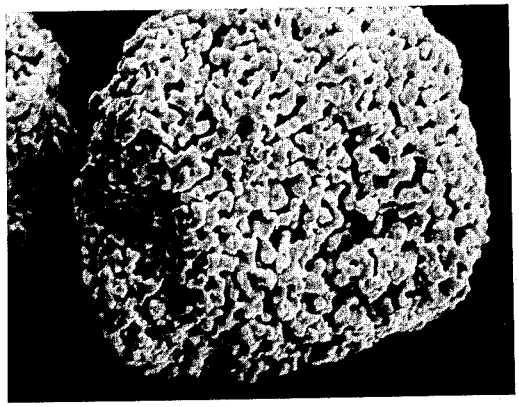
FIGS. 3, 4 and 5 show individual agglomerates at 800 magnification after thermal conditioning for 30 minutes in accordance with this invention.
Figure 4:
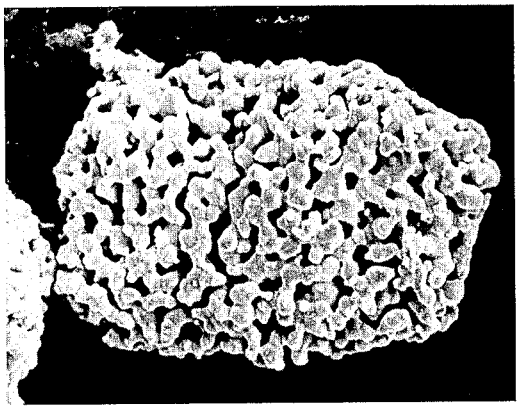
Figure 5:
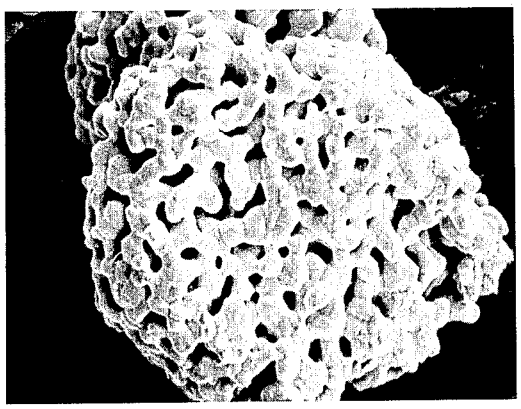

FIGS. 1 through 5 illustrate what thermal conditioning accomplishes. FIGS. 1 and 2 are of as-produced cemented silver powder before thermal conditioned. The powder comprises somewhat irregularly rounded agglomerates of partially fused fine particles. Some particle to particle bond strength exists, but it is too weak to overcome blending forces. After thermal conditioning, necks form between the particles, as shown in FIGS. 3, 4 and 5, making the particle to particle bonds strong enough to resist fracturing during subsequent processing. The conditioning temperatures for FIGS. 3, 4 and 5 were 450, 500 and 540° C., respectively. It can be seen that increased temperatures result in increased internal mean particle diameter and slightly smaller rounder aggregates.

Figure 6:
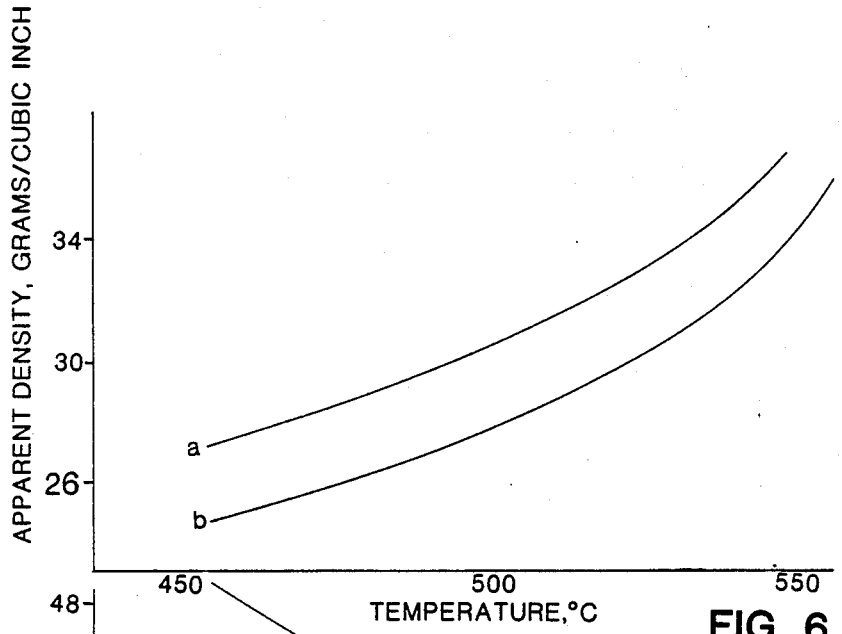
FIGS. 6 and 7 show how the apparent density and the flow rate of the silver powder vary with thermal conditioning temperature.

FIG. 6 (curve b) shows that apparent density can be increased by increasing the thermal conditioning temperature. Blending (curve a) will increase the apparent density even further.

Figure 7:
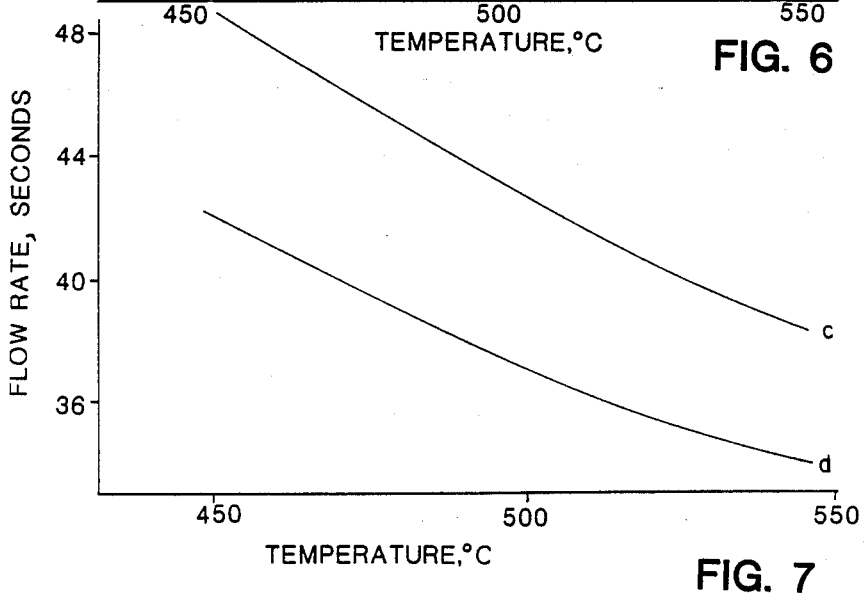

FIG. 7 (curve c) shows that the flow rate can be decreased by increasing the thermal conditioning temperature, and that blending (curve d) will decrease the flow rate even further.

The invention may be utilized as follows. Say a particular application, for example, a controlled porosity silver electrode, required silver powder with an apparent density of 30 to 34 gm/cu.in. Reference to FIG. 6 shows that such a powder could be produced by thermal conditioning for 30 minutes at about 520° to 545° C., or by thermal conditioning at about 490° to 530° C., followed by blending.

I claim:

1. In the manufacture of cemented silver powder by the process of precipitating a silver compound from a silver solution and then reducing the silven compound precipitate to pure silver by reaction with a metal less electronegative than silver, the steps which comprise resuspending the silver compound preceipitate prior to reaction with the less electronegative metal, and heating the cemented silver powder in a furnace to increase the apparent density of the cemented silver powder while preserving the morphology of the cemented silver powder.

2. The method of claim 1 wherein said heating step is at 450° to 540° C.

3. Silver powder made in accordance with claim 1.

* * * * *